United States Patent [19]

Hartzler

[11] Patent Number: 4,985,046

[45] Date of Patent: Jan. 15, 1991

[54] PROCESS FOR PREPARING POLY (PARAPHENYLENE TEREPHTHALAMIDE) FIBERS DYEABLE WITH CATIONIC DYES

[75] Inventor: Jon D. Hartzler, Midlothian, Va.

[73] Assignee: E. I. Du Pont de Nemours and Company, Wilmington, Del.

[21] Appl. No.: 363,916

[22] Filed: Jun. 9, 1989

[51] Int. Cl.[5] ..... C09B 44/00; D06P 3/24

[52] U.S. Cl. ..... 8/654; 8/538; 8/567; 8/568; 8/574; 8/585; 8/587; 8/611; 8/618; 8/657; 8/925

[58] Field of Search ..... 8/654, 567, 568, 574, 8/585, 611, 657

[56] References Cited

U.S. PATENT DOCUMENTS 3,869,429 3/1975 Blades ..... 524/341

3,888,821 6/1975 Milford, Jr. ..... 524/91

FOREIGN PATENT DOCUMENTS 52-37882 1/1977 Japan .

52-037882 3/1977 Japan .

61-047883 3/1986 Japan .

1438067 4/1974 United Kingdom .

*Primary Examiner*—A. Lionel Clingman

[57] ABSTRACT

There is provided by this invention a process for preparing poly(paraphenylene terephthalamide) fibers dyeable with cationic dyes. The process comprises soaking poly(paraphenylene terephthalamide) fibers in sulfuric acid, washing the fibers and dipping the acid soaked fibers or never-dried PPD-T fibers in an aqueous solution of a dye promoting species. The fibers can then be dried and subsequently dyed.

12 Claims, No Drawings

PROCESS FOR PREPARING POLY (PARAPHENYLENE TEREPHTHALAMIDE) FIBERS DYEABLE WITH CATIONIC DYES

BACKGROUND OF THE INVENTION

1. Field of the Invention

This invention relates to a process for preparing poly(paraphenylene terephthalamide) fibers dyeable with cationic dyes and the dyed fibers produced thereby.

2. Description of the Prior Art

Fibers of poly(paraphenylene terephthalamide) offer high performance features such as flame resistance, very high tenacity and modulus, strength retention at elevated temperatures and good flex life. Accordingly, fibers of poly(paraphenylene terephthalamide) have found utility in various applications such as protective clothing, flame-resistant draperies, upholstery and carpeting. Often it is desirable for such end-use applications that the poly(paraphenylene terephthalamide) fibers be dyed. It is known that the molecular features of high crystallinity, stiff molecular chain, high interchain bonding forces and the like which contribute to the superior properties of the poly(paraphenylene terephthalamide) fibers make dyeing of these fibers difficult.

Various techniques have been proposed for dyeing fibers of poly(paraphenylene terephthalamide). For example, the dye can be incorporated into the solution from which the poly(paraphenylene terephthalamide) fibers are spun, see for example U.S. Pat. No. 3,888,821 and British Patent No. 1,438,067. However, making fibers of poly(paraphenylene terephthalamide) requires the use of extreme spinning conditions which can degrade the dye. This "spun-in" route has other problems such as interfering with fiber formation and contaminating the equipment. Further, it often is not economical to prepare and store separate inventories of fibers for each color of interest.

British Patent No. 1,438,067 to Moulds and Vance teaches imbibing an impregnant into never-dried fibers by passing the never-dried fibers through an aqueous bath containing the impregnant prior to dyeing. The impregnant serves as a "structure prop" which prevents collapse of the water swollen fibers on drying. Preferably the impregnant is a material selected from the group consisting of antioxidants, UV screeners, dyes, antistats and flame retardants such as tetrakis(hydroxymethyl)-phosphonium chloride or oxide. The dried impregnated fibers may subsequently be dyed in an aqueous dye bath while corresponding fibers dried without impregnant may be dyed only under much more vigorous conditions, including the use of dye carriers, such as acetophenone.

Another process to dye fibers of poly(paraphenylene terephthalamide) is suggested in Japanese Kokai Patent No. Sho 52(1977)-37882. Aromatic polyamide fibers are pretreated with a sulfuric acid solution followed by treatment in a bath which contains 5 weight percent or more of a water soluble compound whose melting point is 100° C. or higher. The fibers can be dried and subsequently dyed.

SUMMARY OF THE INVENTION

There is provided by this invention a process for preparing poly(paraphenylene terephthalamide) fibers dyeable with cationic dyes which comprises;

(a) soaking poly(paraphenylene terephthalamide) fibers in an 80 to 90% sulfuric acid solution for at least 2 seconds at a temperature in the range from 10° to 50° C.;

(b) washing the acid-soaked fibers with water until substantially all the acid is removed;

(c) contacting the fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and 1,3-dimethyl-3,4,5,6-tetrahydro-2(1H)-pyrimidinone.

Also provided by this invention is a process for preparing poly(paraphenylene terephthalamide) fibers dyeable with cationic dyes comprising:

(a) contacting never-dried poly(paraphenylene terephthalamide) fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and 1,3-dimethyl-3,4,5,6-tetrahydro-2(1H)-pyrimidinone.

The fibers produced by the process of this invention can be dried and subsequently dyed in an aqueous dye bath comprising a dissolved, water soluble, cationic dye.

Also provided by the invention are poly(paraphenylene terephthalamide) fibers dyeable with cationic dyes and the dyed fibers produced by the process of the invention.

DETAILED DESCRIPTION OF THE INVENTION

Poly(paraphenylene terephthalamide) (hereinafter "PPD-T") fibers suitable for use in the present invention are produced by the general procedure of Blades, U.S. Pat. No. 3,869,429. U.S. Pat. No. 3,869,429 is hereby incorporated by reference.

The term "poly(paraphenylene terephthalamide)" as used herein, refers to the homopolymer resulting from mole-for-mole polymerization of paraphenylene diamine and terephthaloyl chloride and, also, copolymers resulting from incorporation of small amounts of other aromatic diamines with the paraphenylene diamine and of small amounts of other aromatic diacid chlorides with the terephthaloyl chloride.

The term "never-dried" refers to those PPD-T fibers spun according to the general procedure of Blades, U.S. Pat. No. 3,869,429 that have been neutralized by means of a caustic wash and wound onto a bobbin but have not been dried. The moisture content of this yarn is typically greater than 75 weight % on a dry yarn basis. The moisture content of the never-dried yarn can not drop below about 25 weight % on a dry yarn basis to practice the process of this invention as it applies to never-dried fibers.

Generally, the fibers used in the process of the present invention will not be never-dried fibers. Generally the fibers will be relatively dry such as fibers having a moisture content of about 3.5 to 7% water. To prepare such PPD-T fibers by the process of this invention, the fibers are soaked in a bath of sulfuric acid in the range of 80 to 90% sulfuric acid. At sulfuric acid concentrations above this range the solvating power is too high, causing damage to the fibers. At sulfuric acid concentrations below this range the treatment time is lengthened and no longer practical.

The temperature of the sulfuric acid bath is in the range from 10° to 50° C. The upper limit on temperature is governed by the adverse effect on fiber tensile properties and filament fusion.

The fibers are soaked in the sulfuric acid solution for at least 2 seconds. With very short exposure times it is difficult, ultimately, to achieve satisfactory depth of shade. Longer exposure times produce excessive cracking of the filaments and cause loss of tensile properties. Exposure time to the acid can be reduced by increasing the temperature and/or increasing the acid concentrations. Effective practice of the process of this invention requires a reasonable combination of acid concentration, temperature and soaking time.

The acid soaked PPD-T fibers are washed well with water to remove substantially all the sulfuric acid. The conditions for washing are not critical. Optionally, the fiber can be neutralized with a base such as sodium bicarbonate solution which can be added to the wash water or used in separate, subsequent step.

Never-dried PPD-T fibers do not require the acid treatment described herein and are passed directly in the water swollen state to the aqueous solution containing dye promoter.

The acid treated fibers or never-dried fibers are then contacted, without drying, with a 1 to 25% by weight aqueous solution of at least one of a dye promoting species. The dye promoters of this invention are water soluble low molecular weight liquids melting at or below 27 degrees C. and are not generally considered to be of the class of materials described as anti-oxidants, UV screeners, dyes, flame retardants and antistats. The dye promoters are selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone. Without contacting the fibers with the solution of dye promoting species, the acid treated fibers or never-dried fibers if allowed to dry, will only dye to a faint color. The fibers are contacted with the solution containing the dye promoting species for a time sufficient for the dye promoting species to diffuse into the fiber surface. A time range of 2 seconds to 30 minutes has been demonstrated. The dye promoting species diffuses into the exterior volume element of fibers that have been modified by the acid treatment. In never-dried fibers, the dye promoting species penetrates the entire fiber cross section. When the fiber is dried, the dye promoting species is retained by the fiber and prevents the fiber structure from collapsing.

The required temperature for contacting the fibers with the dye promoting soak is not critical and is usually in the range from 10° to 60° C.

The fibers are subsequently dried without rinsing. Rinsing the fibers can remove substantially all the dye promoting species and once dried, the rinsed fibers are no longer dyeable to a deep shade.

The PPD-T fibers produced by the process of this invention are readily dyed with a cationic dye or basic dye. Examples of suitable cationic dyes are "Maxilon" Red GRL and Blue GRLA 100. "Maxilon" dyes are a product of Ciba Geigy Corp., Greensboro, N.C.

The method for dyeing the PPD-T fibers of this invention can be any conventional dipping, continuous dyeing or textile printing technique employing a water soluble cationic dye.

TEST METHODS

Tensile Properties

Tenacity (breaking tenacity), elongation (breaking elongation), and modulus are determined by breaking test filaments or yarns on an Instron tester (Instron Engineering Corp., Canton, Mass.).

Tenacity is reported as the breaking stress of a filament divided by the original linear density of the filament sample. Modulus is reported as the slope of the initial stress/strain curve from 0.1 to 0.4% strain converted to the same units as tenacity. Elongation is the percent increase in length at break. (Both tenacity and modulus are first computed in g/denier units which, when multiplied by 0.8826, yield dN/tex units).

Yarns are twisted to a twist multiplier (TM) of 1.1 where TM=[tpi(denier)exp1/2]/73 and then preconditioned at 50°±2° C. for 3±0.2 hr. The yarn is then conditioned at 75°±2° F., 55±2% RH for a minimum of 14 hours and then broken with a 10 inch gage length. All samples are elongated at a constant rate of extension (50%/minute) until the sample breaks.

Linear Density

The denier or linear density of a yarn is determined by weighing a known length of yarn. Denier is defined as the weight, in grams, of 9000 meters of yarn.

In actual practice, the measured denier of a sample, test conditions and sample identification are fed into a computer before the start of a test; the computer records the load-elongation curve of the sample as it is broken and then calculates the properties.

EXAMPLES

Example A

To demonstrate the effect of acid strength on the subsequent dyeability of the fibers, 1 yard skeins of finish-free 1500 denier PPD-T yarn were immersed in sulfuric acid solutions of the concentrations shown in Table I. These solutions were prepared by mixing appropriate amounts of concentrated sulfuric acid (96.5%) with water. After soaking for 15 seconds, the skeins were removed and rinsed thoroughly with water to remove residual acid. The skeins were transferred to a dye bath without drying and were then heated for 30 minutes at the boil in a solution of "Maxilon" Red GRL dye (0.024 g/500 ml) adjusted to a pH of 3.5 with glacial acetic acid. A sulfuric acid concentration of greater than or equal to 80% is required to effect the structural changes that make the yarn dyeable by a cationic dye.

TABLE I

| Yarn Item | Conc. $H_2SO_4$ (96.5%), ML | $H_2O$, ML | $H_2SO_4$ Conc, % | Color |
|---|---|---|---|---|
| 1 | 71 | 370 | 25 | Gold |
| 2 | 141 | 240 | 50 | Gold |
| 3 | 160 | 179 | 60 | Gold |
| 4 | 190 | 132 | 70 | Gold |
| 5 | 220 | 84 | 80 | Pink |
| 6 | 272 | 68 | 85 | Red |

TABLE I-continued

| Yarn Item Color | Conc. $H_2SO_4$ (96.5%), ML | $H_2O$, ML | $H_2SO_4$ Conc, % | |
|---|---|---|---|---|
| 7 | 0 | 300 | 0 | Gold |

Example B

To demonstrate the effect of acid exposure time on the subsequent dyeability of the fibers, a skein of finish-free 1500 denier PPD-T yarn was immersed in 85% sulfuric acid solution for various periods of time as shown in Table II. The acid treated skeins were then rinsed well with water and subsequently dyed using the dyeing procedure of Example A. Good depth of shade is achieved upon dyeing following acid treatment for a period as short as 2 seconds.

TABLE II

| Item | Soak Time, Seconds | Color |
|---|---|---|
| 1 | 2 | Red |
| 2 | 4 | Red |
| 3 | 8 | Red |
| 4 | 15 | Red |
| 5 | 30 | Red |
| 6 | 120 | Red |
| 7 | 0 | Gold |

Example C

To demonstrate the effect of acid treatment on fiber properties, PPD-T yarn was wrapped around a glass spool (28 wraps/spool). The spool was immersed in 85% sulfuric acid for various periods of time as shown in Table III. The spool was removed from the acid bath and placed in a beaker of deionized water for 15 seconds. The spool was then placed in a second beaker of water and rinsed for 5 minutes with running water. The yarn was patted dry with a paper towel while still on the spool and then removed for testing. Results are the average of 5, 10-inch yarn breaks at a Twist Multiplier of 1.1. A control yarn was treated similarly except water was used instead of 85% sulfuric acid. Tenacity and modulus were calculated based on a bone dry yarn denier of 1427.

TABLE III

| Item | Acid Exposure Time, Seconds | Tenacity, GPD | Elongation, % | Modulus, GPD |
|---|---|---|---|---|
| 1 | 15 | 20.4 | 3.27 | 572 |
| 2 | 120 | 18.9 | 3.14 | 557 |
| 3 | 300 | 18.3 | 3.23 | 540 |
| 4 | 0 | 23.2 | 3.33 | 629 |

Example #1

To demonstrate color retention in fibers treated with dye promoter, 1-meter skeins of finish-free 1500 denier PPD-T yarn were immersed in 85% sulfuric acid for 10 seconds. The skeins were then rinsed well with water, soaked in 0.5% sodium bicarbonate solution and rinsed again with water. Following the treatments summarized in Table IV, the skeins were heated for 30 minutes at the boil in a solution of "Maxilon" Red GRL dye (0.025 g/1000 ml water). Acid treated yarn that is not treated with the dye promoting species can be dyed only to a faint pink color if allowed to dry prior to dyeing. In the presence of the dye promoting species, bright red coloration is obtained upon dyeing even after the fibers have been dried in air or in an oven.

TABLE IV

| Item | Treatment | Yarn Color |
|---|---|---|
| 1 | None. Placed wet into dye bath | Red |
| 2 | Dried in air for 60 minutes | Pink |
| 3 | Soaked 30 minutes in 10% aqueous tetramethylene sulfone solution | Red |
| 4 | Same as 3 then dried in air for 60 minutes before dyeing | Red |
| 5 | Same as 3 then dried in a 120° C. oven before dyeing. | Red |

Example #2

To demonstrate the effect of treatment time in the dye promoter bath, 1-meter skeins of 1500 denier PPD-T yarn were immersed for 10 seconds in 85% sulfuric acid solution. The skeins were removed, rinsed well with water, soaked 30 minutes in 1% sodium bicarbonate solution and then rinsed again with water. The wet skeins were placed in a 10% aqueous solution of tetramethylene sulfone for various periods of time as shown in Table V. The skeins were dried for 2 hours at 120° C. in a vacuum oven and then dyed according to the procedure of Example #1.

TABLE V

| Item | Soak Time, Seconds | Yarn Color |
|---|---|---|
| 1 | 15 | Red |
| 2 | 30 | Red |
| 3 | 60 | Red |
| 4 | 300 | Red |
| 5 | 600 | Red |
| 6 | 1800 | Red |
| 7 | 0 | Gold |

Example #3

To demonstrate a variety of dye promoters, skeins of PPD-T yarn were treated with aqueous solutions of various dye promoters. 1-meter skeins of 1500 denier PPD-T yarn were immersed for 10 seconds in 85% sulfuric acid solution. The skeins were removed, rinsed well with water, soaked 30 minutes in 1% sodium bicarbonate solution and then rinsed again with water. The wet skeins were placed in a 10% aqueous solution of various dye promoters for various times as shown in Table VI. The skeins were dried for 2 hours at 120° C. in a vacuum oven and then dyed according to the procedure of Example #1.

TABLE VI

| Item | Dye Promoter | Soak Time, Minutes | Color |
|---|---|---|---|
| 1 | 10% tetramethylene sulfone | 5 | Red |
| 2 | 10% tetramethylene sulfoxide | 5 | Red |
| 3 | 10% 1-methyl-2-pyridone | 5 | Red |
| 4 | 10% 1-methyl-pyrrolidinone | 5 | Red |
| 5 | 10% propylene carbonate | 5 | Light Red |
| 6 | 10% dimethylsulfoxide | 1 | Light Red |
| 7 | 10% 1-ethyl-2-pyrrolidinone | 1 | Light Red |
| 8 | 10% 1,3-dimethyl-2-imidazolidinone | 1 | Red |
| 9 | 10% glycerol | 1 | Red |
| 10 | 10% tetramethylurea | 1 | Red |
| 11 | 10% tetramethylurea | .17 | Red |
| 12 | 10% 1,3-dimethyl-3,4,5,6-tetrahydro-2(1H)-pyrimidinone | 1 | Red |
| 13 | 10% 1,3-dimethyl-3,4,5,6-tetrahydro-2(1H)-pyrimidinone | .17 | Red |

TABLE VI-continued

| Item | Dye Promoter | Soak Time, Minutes | Color |
|---|---|---|---|
| 14 | no dye promoter | | Peach |

Example D

To demonstrate the effect of extracting the dye promoter from the fibers prior to dyeing, 1-meter skeins of finish-free 1500 denier PPD-T yarn were immersed in 85% sulfuric acid solution for 10 seconds. The skeins were rinsed well with water and 0.5% sodium bicarbonate solution and then soaked in a 10% aqueous tetramethylene sulfone solution for 30 minutes. Prior to dyeing as described in Examples #1, the skeins A, B and C were treated as shown in Table VII. The dye promoting species can be removed by thoroughly rinsing the yarn. Once dried, the rinsed yarn is no longer dyeable to a deep shade as shown by the "peach" shade of item C.

TABLE VII

| Procedure | Item A | Item B | Item C |
|---|---|---|---|
| Rinse | No | No | Yes |
| Oven Dry (2 hr @ 100° C.) | No | Yes | Yes |
| Air Dry | Yes | No | No |
| Color | Red | Red | Peach |

Example #4

This example shows that never-dried yarns treated with a dye promoter in accordance with the invention are also dyeable after drying.

PPD-T yarn was taken directly from the spinning machine without drying (residual moisture was ~100 wt % based on a dry yarn basis), treated as shown below and then dyed by heating for 30 minutes at the boil in an aqueous solutin of Maxilon Red GRL dye (1000 ml water, 0.1 g dye, 1 ml acetic acid and 1.0 g sodium acetate of pH~4).

TABLE VIII

| Item | Treatment | Color |
|---|---|---|
| 1 | None, dyed in the wet state | Red |
| 2 | Soaked 60 seconds in 10% aqueous tetramethylene sulfone solution Air dried overnight | Red |
| 3 | Same as 2 but soaked in 10% glycerin solution instead of sulfone | Red<br>Red |
| 4 | No promoter, dried in air overnight | Peach |

Example #5

Coloration of the fibers at low dye promoting species concentration and short exposure time were demonstrated in this example. 1-meter skeins of 1500 denier PPD-T yarn were immersed for 10 seconds in 85% sulfuric acid solution. The skeins were removed, rinsed well with water, soaked 30 minutes in 1% sodium bicarbonate solution and then rinsed again with water. The skeins were placed in an aqueous solution of 1,3-dimethyl-2-imidazolidinone (DMI) for various periods of time and concentration as shown in Table IX. The skeins were dried overnight. The skeins were heated for 30 minutes at the boil in a solution of 1000 ml water, 0.025 g "Maxilon" Red GRL dye, 1 ml acetic acid and 1.0 g sodium acetate. The pH of the dye solution was 3.8.

TABLE IX

| Exposure Time, Seconds | Yarn Color at Various DMI Concentrations (Wt %) | | | | |
|---|---|---|---|---|---|
| | 0 | 1 | 2 | 4 | 7.5 |
| 2 | peach | red | red | red | red |
| 4 | peach | red | red | red | red |
| 6 | peach | red | red | red | red |
| 10 | peach | red | red | red | red |

Example E

As a control, poly(methaphenylene isophthalamide) yarn was treated in 85% sulfuric acid for 5 to 10 seconds. In contrast to PPD-T yarn, this yarn was reduced to a relatively stiff mass with many filaments becoming fused and losing their individual identity. To avoid fusing filaments, the yarn had to be dipped into the acid bath and quickly withdrawn. Yarn exposed only briefly to acid in this manner was dull and pink colored when subsequently dyed according to the dyeing procedure of Example A.

I claim:

1. A process for preparing poly(paraphenylene terephthalamide) fibers dyeable with cationic dyes comprising;
   (a) soaking poly(paraphenylene terephthalamide) fibers in an 80 to 90% sulfuric acid solution for at least 2 seconds at a temperature in the range from 10° to 50° C.;
   (b) washing the acid-soaked fibers with water until substantially all the acid is removed;
   (c) contacting the fibers with an aqueous solution comprising 1 to 25% by weight of a solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone.

2. A process for preparing poly(paraphenylene terephthalamide) fibers dyeable with cationic dyes comprising;
   (a) soaking poly(paraphenylene terephthalamide) fibers in an 80 to 90% sulfuric acid solution for at least 2 seconds at a temperature in the range from 10° to 50° C.;
   (b) washing the acid-soaked fibers with water until substantially all the acid is removed;
   (c) contacting the fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidaxolidinone, glycerol, tetramethylurea and, 1,3-dimethyl-3,4,5,6-tetrahydro-2(1H)-pyrimidinone;
   (d) drying the fibers.

3. A process for preparing dyed poly(paraphenylene terephthalamide) fibers which comprises;
   (a) soaking poly(paraphenylene terephthalamide) fibers in an 80 to 90% sulfuric acid solution for at least 2 seconds at a temperature in the range from 10° to 50° C.;

(b) washing the acid-soaked fibers with water until substantially all the acid is removed;

(c) contacting the fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone;

(d) drying the fibers and;

(e) dyeing the fibers in a aqueous dye bath comprising a dissolved, water soluble, cationic dye.

4. A process for preparing dyed poly(paraphenylene terephthalamide) fibers which comprises;

(a) soaking poly(paraphenylene terephthalamide) fibers in an 80 to 90% sulfuric acid solution for at least 2 seconds at a temperature in the range from 10° to 50° C.;

(b) washing the acid-soaked fibers with water until substantially all the acid is removed;

(c) contacting the fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone and;

(d) dyeing the fibers in a aqueous dye bath comprising a dissolved, water soluble, cationic dye.

5. A process for preparing poly(paraphenylene terephthalamide) fibers dyeable with cationic dyes comprising:

(a) contacting never-dried poly(paraphenylene terephthalamide) fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone.

6. A process for preparing poly(paraphenylene terephthalamide) fibers dyeable with cationic dyes comprising:

(a) contacting never-dried poly(paraphenylene terephthalamide) fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone;

(b) drying the fibers.

7. A process for preparing dyed poly(paraphenylene terephthalamide) fibers which comprises:

(a) contacting never-dried poly(paraphenylene terephthalamide) fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone;

(b) drying the fibers and;

(c) dyeing the fibers in an aqueous dye bath comprising a dissolved, water soluble, cationic dye.

8. A process for preparing dyed poly(paraphenylene terephthalamide) fibers which comprises:

(a) contacting never-dried poly(paraphenylene terephthalamide) fibers with an aqueous solution comprising 1 to 25% by weight of the solution of at least one of a dye promoting species selected from the group consisting of tetramethylene sulfone, tetramethylene sulfoxide, 1-methyl-2-pyridone, propylene carbonate, 1-methyl-2-pyrrolidinone, dimethylsulfoxide, 1-ethyl-2-pyrrolidinone, 1,3-dimethyl-2-imidazolidinone, glycerol, tetramethylurea and, 1,3-dimethyl-3,4,5,6-tetrahydro-2(1H)-pyrimidinone and;

(b) dyeing the fibers in an aqueous dye bath comprising a dissolved, water soluble, cationic dye.

9. The process of claim 1, 2, 3, 4, 5, 6, 7 or 8 wherein the fibers are contacted with the aqueous solution of a dye promoting species for 2 seconds to 30 minutes.

10. The process of claim 1, 2, 3 or 4 wherein the fibers are neutralized with a base prior to contacting with the aqueous solution of a dye promoting species.

11. The dyeable fibers produced by the process of claim 1, 2, 5 or 6.

12. The dyed fibers produced by the process of claim 3, 4, 7 or 8.

* * * * *